United States Patent [19]

Wyatt

[11] Patent Number: 4,996,727

[45] Date of Patent: Mar. 5, 1991

[54] DISPOSABLE WASTE BAG

[75] Inventor: Cynthia M. Wyatt, Glendale, Calif.

[73] Assignee: Guardian Products, Inc., Arleta, Calif.

[21] Appl. No.: 387,132

[22] Filed: Jul. 28, 1989

[51] Int. Cl.[5] ..... A47K 11/06

[52] U.S. Cl. ..... 4/484; 383/34; 383/907

[58] Field of Search ..... 4/451, 452, 453, 457, 4/484; 150/106, 107, 120; 383/4, 7, 15, 12, 34, 105, 907

[56] References Cited

U.S. PATENT DOCUMENTS

| | | | |
|---|---|---|---|
| D. 270,134 | 8/1983 | Stoute . | |
| D. 270,236 | 8/1983 | Stoute . | |
| 484,101 | 10/1892 | Langfeld | 150/106 |
| 1,127,151 | 2/1915 | Alford . | |
| 1,995,830 | 3/1935 | Barnsby | 383/34 X |
| 2,471,309 | 5/1949 | Chandler . | |
| 2,537,504 | 6/1951 | Anderson | 4/484 X |
| 2,654,892 | 10/1953 | Szabo . | |
| 2,801,426 | 8/1957 | Gorce et al. . | |
| 2,819,472 | 1/1958 | Sullivan . | |
| 2,855,607 | 10/1958 | Sullivan . | |
| 2,991,031 | 7/1960 | Sederquist . | |
| 3,005,994 | 10/1961 | Heil . | |
| 3,010,640 | 11/1961 | Kugler . | |
| 3,099,017 | 5/1962 | Sullivan . | |
| 3,194,185 | 7/1965 | Spinosa | 383/36 X |
| 3,381,315 | 5/1968 | Glassberg | 4/484 |
| 3,475,767 | 11/1969 | Friesen et al. . | |
| 3,484,875 | 12/1969 | Eisenberg . | |
| 3,522,922 | 8/1970 | Byron et al. . | |
| 3,848,594 | 11/1974 | Buell . | |
| 3,859,125 | 1/1975 | Miller et al. . | |
| 3,860,003 | 1/1975 | Buell . | |
| 3,920,179 | 11/1975 | Hall | 383/12 |
| 3,950,795 | 4/1976 | Dalton . | |
| 4,081,301 | 3/1978 | Buell . | |
| 4,139,037 | 2/1979 | McGuigan . | |
| 4,296,506 | 10/1981 | Stoute . | |
| 4,343,053 | 8/1982 | O'Conner . | |
| 4,573,986 | 3/1986 | Minetola et al. . | |
| 4,578,071 | 3/1986 | Buell . | |
| 4,720,880 | 1/1988 | Barreau | 4/484 X |
| 4,735,340 | 4/1988 | Preston . | |
| 4,748,069 | 5/1978 | Cullen . | |
| 4,749,600 | 6/1988 | Cullen et al. . | |
| 4,820,291 | 4/1989 | Terauchi et al. | 4/144.3 X |

FOREIGN PATENT DOCUMENTS

| | | | |
|---|---|---|---|
| 2906560 | 8/1980 | Fed. Rep. of Germany | 4/452 |

OTHER PUBLICATIONS

Restop flyer, published by Star Pioneer Products, Inc., 2691 Dow Ave., Suite D, Tustin, Calif. 92680 (1 page) (date unknown).

Restop label, published by Star Pioneer Products, Inc., Tustin, Calif. 92680 (1 page) (date unknown).

Brief Relief brochure, published by American Innotek, Inc., 334 Via Vera Cruz, Suite 251, San Marcos, Calif. 92069 (6 pages) (date unknown).

Chlorasorb flyer, published by Huntington Laboratories, Inc., Huntington, Ind. 46750 (1 page) (date unknown).

Liqua-Gel flyer, published by Star Pioneer Products, Inc., 2650 Walnut Ave., Suite R, Tustin, Calif. 92680 (1 page) (date unknown).

*Primary Examiner*—Charles E. Phillips

*Attorney, Agent, or Firm*—Christie, Parker & Hale

[57] ABSTRACT

A disposable waste bag having a flexible enclosure secured around the perimeter of an opening in a semirigid sheet of material. The semirigid sheet is foldable along a line across the middle to allow the bag to be opened and placed in position on a portable commode or bedpan. After use, the two halves of semirigid sheet material are brought together and secured to seal the bag. A gelling compound is included in the bag to solidify any liquid material deposited in it.

12 Claims, 2 Drawing Sheets

DISPOSABLE WASTE BAG

BACKGROUND OF THE INVENTION

The present invention relates disposable waste bags for use independently or in conjunction with a commode pail.

The present invention addresses problems encountered in the use of portable commodes by invalids, disabled persons, and hospital patients. Conventional commodes use a rigid container which is removable from a commode chair for disposal of the waste products excreted therein and subsequent cleaning and disinfecting.

Problems such as ineffective disinfecting inherent in the use of reusable equipment in a hospital context make use of disposable equipment highly desirable. Prior solutions to the above problem have involved the use of several types of disposable commode liners. Such liners have presented problems due to failure or disintegration, difficulties in sealing or closing and problems in containing the contents without spilling.

SUMMARY OF THE INVENTION

The present invention solves the above problems to a significant degree and provides a disposable waste bag which is usable independently or with portable commodes, hospital commodes, conventional bedpans and the like. The present invention is inexpensive to manufacture, substantially eliminates the problems of cross-contamination, addresses the problem of spillage of liquid materials within the bag, and provides a secure and efficient means for sealing the waste material within the bag to permit fast and efficient disposal of the bag and its contents.

The present invention provides a disposable waste bag comprising a first circularly shaped sheet of a liquid-tight material. A second circularly shaped sheet of a liquid-tight material is also provided with the second sheet being secured to the first sheet along a portion of their respective perimeters to define a waste containing enclosure having an open end and a closed end. A sheet of semirigid material having an opening in the center thereof which conforms to the size of the open end of the enclosure of liquid-tight material is provided with the open end of the enclosure being secured to the perimeter of the opening in the semirigid material. Means are provided for folding the semirigid sheet in half to close the waste containing enclosure and handle means are incorporated into the semirigid material to permit carrying of the waste bag before and after closure.

Preferably the handle means are formed into the semirigid material by means of placing along apertures located adjacent the perimeter on opposite sides of the central opening and on opposite sides of the folding means. By bringing the two halves of the semirigid material together, a pair of handles are provided in a closed position for easy carrying.

As a further feature of the invention, an adhesive strip is provided adjacent the perimeter of three sides of the semirigid material with detachable cover strips overlayed on the adhesive strips. When it is desired to seal the waste bag, the detachable strips are removed, uncovering the adhesive strips which are then pressure secured to the opposite side of the semirigid material to close and seal the waste bag.

In the presently preferred embodiment a gelling compound or liquid absorber is also placed within the waste bag and secured in the interior thereof. Upon liquid waste material coming into contact with a packet of gelling compound, the compound or absorber is released, causing the material in the bag to solidify, thereby eliminating the tendency of liquid material to slosh or move around in the waste bag.

Several important advantages flow from the design of the present invention. The most important of which is that the present invention provides a liner for conventional commode pails which eliminates the problems inherent in a rigid reusable pail and can also be used as a substitute for such a pail. By placing the present invention upon the commode frame with the enclosure extending down into the commode pail, a complete barrier between the waste material and the commode pail is provided.

The present invention is also ideally suited for use by invalids and the handicapped because the structure and functioning of the waste bag of the invention lends itself to operation with one hand. The disposable bag can be placed in the commode pail and the sides of the semirigid material opened to lie flat on the surface of the commode prior to use. The detachable strip or strips are then removed so that at least one strip of adhesive is exposed. The handle at one side is then grasped and folded over to the other handle. When the side of the semirigid material having the adhesive is brought to bear against the other side, the two sides are strongly secured to each other. At the same time the gelling compound provided in the enclosure has solidified any liquid waste material in the bag making disposal easy and convenient.

BRIEF DESCRIPTION OF THE DRAWINGS

The present invention will be better understood by reference to the figures of the drawing wherein.

DETAILED DESCRIPTION

Figure 1:
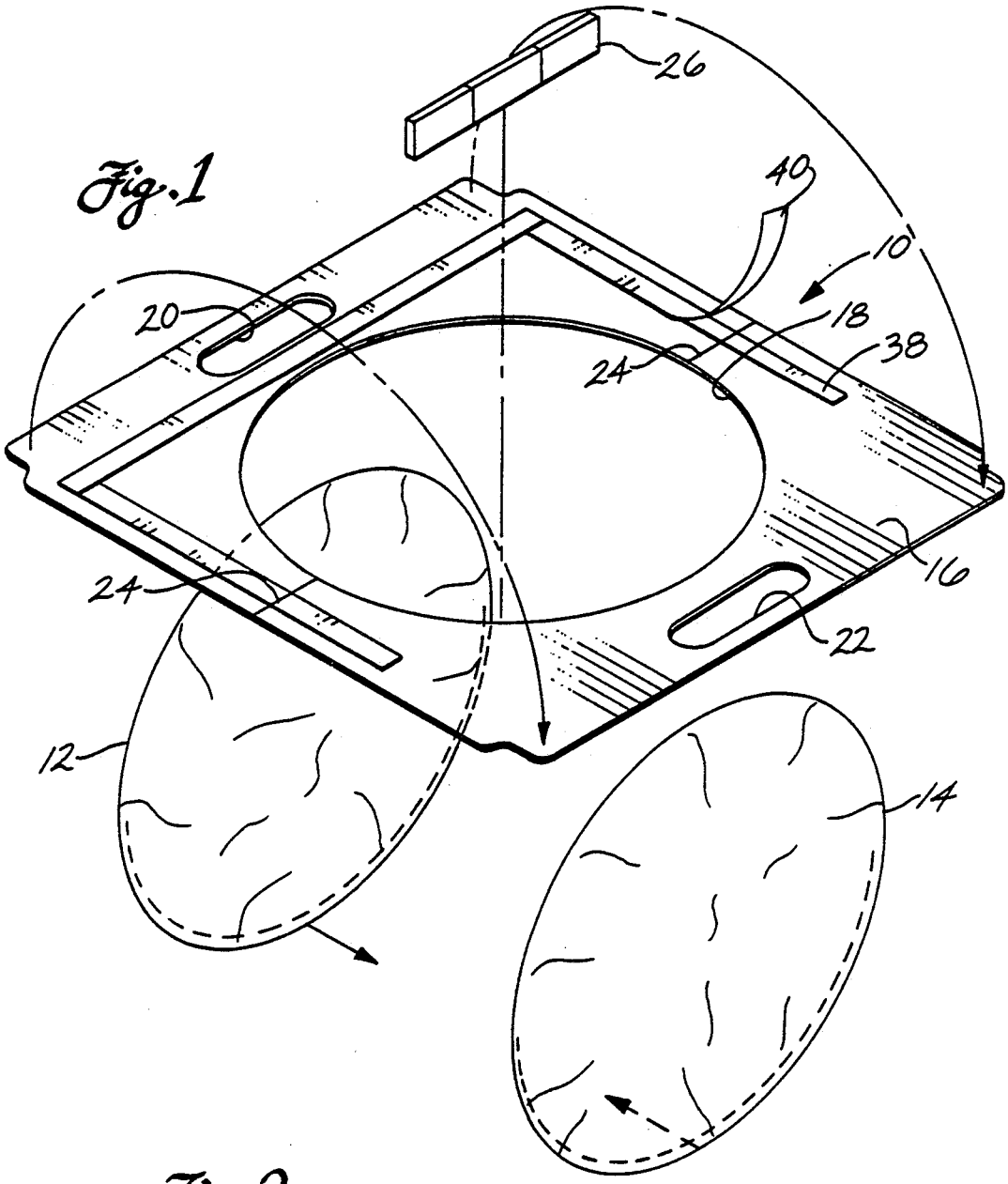
FIG. 1 is an exploded view of the waste bag of the present invention showing the components comprising the bag construction.

A disposable waste bag 10 according to the present invention is shown in an exploded view in FIG. 1. As shown therein the bag comprises a first circular sheet of liquid-tight flexible material 12. A second sheet 14 of a flexible liquid-tight material is also provided. In assembly the first sheet 12 and second sheet 14 are brought together and secured around the lower half of their perimeters. Attachment of sheet 12 to sheet 14 is accomplished in one of a number of possible ways with the presently preferred embodiment utilizing heat sealing to attach the edges of the sheets along a length approximately equal to half of their perimeters creating an enclosure in the lower half of the structure and a circular opening in the upper half. Preferably the two sheets are fabricated from a synthetic material such as low-density polyethylene having a thickness of approximately 0.05 inch. In manufacture the two sheets 12 and 14 are stamped or die cut from sheet material prior to assembly as described above.

A sheet of semirigid material 16 such as cardboard is provided which, in the preferred embodiment, is essentially square in configuration and has a circular aperture 18 located in the center thereof. Two elongated apertures 20 and 22 are located on opposite sides of aperture 18 adjacent the edges of sheet 16. These apertures are oval or oblong in shape and as will be discussed in more detail provide handles for carrying the waste bag when the components thereof are completely assembled. Sheet 16 is creased or scored along line 24 for ease of folding the two halves of the sheet 16 together. Finally, a packet 26 of gelling compound is also provided and is placed in the bottom of the enclosure and secured thereto by means of adhesive or other securing means to be firmly retained in the receptacle defined by the waste bag.

Figure 2:
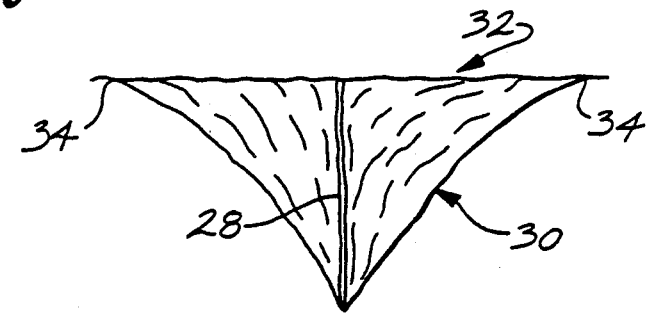
FIG. 2 is a perspective view of the two halves of the flexible portion of the waste bag partially secured together.

In assembly, as indicated above, and as shown in FIG. 2, sheet 12 and sheet 14 are brought together and are heat sealed along their perimeters to define a rim 28 which is essentially semicircular in shape, and defines a semicircular enclosure 30 for receiving and holding waste materials deposited into the waste bag. By not securing the upper perimeter halves of sheets 12 and 14 together, they thereby define an open mouth 32 for the enclosure.

Figure 3:
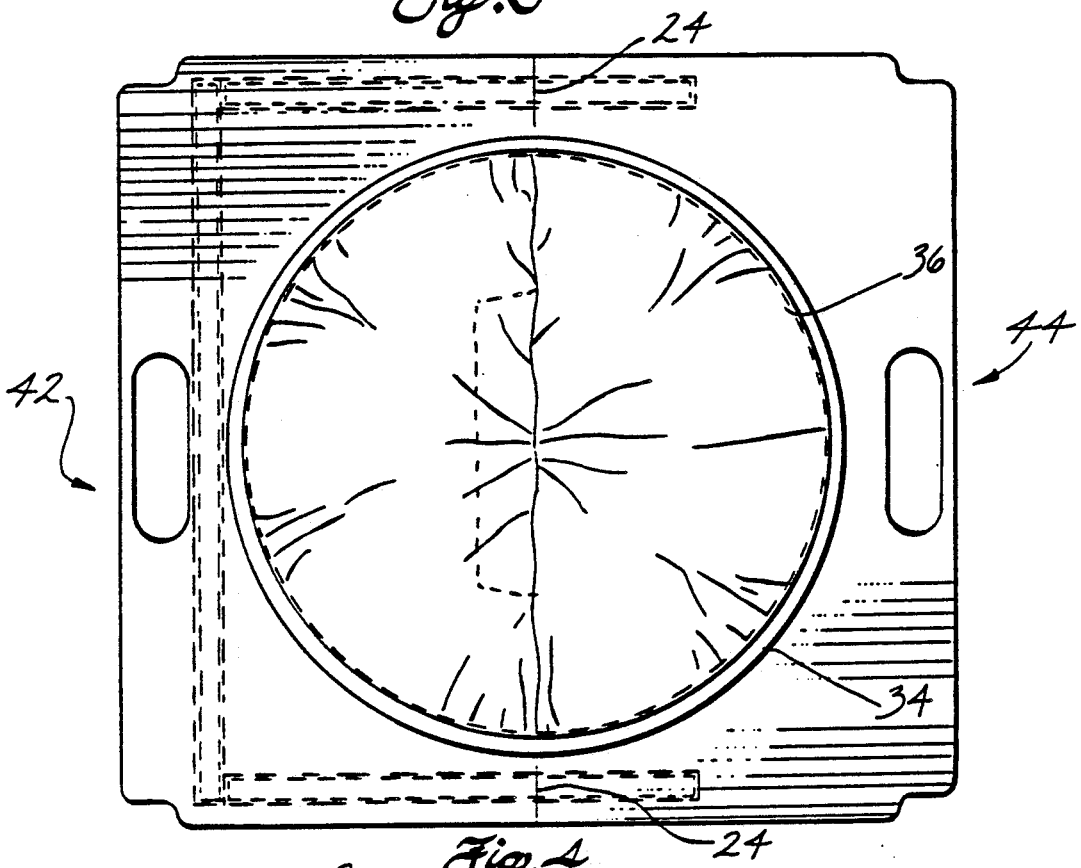
FIG. 3 is a bottom view of the waste bag according to the present invention.

Mouth 32 has a perimeter portion 34 which, as shown in FIG. 3 is secured to the underside of sheet 16. In the preferred embodiment the securing is done by heat sealing the flexible material along perimeter strip 34 which is approximately a quarter inch wide to the underside of circular aperture 18, to thereby define the complete enclosure of the bag with aperture 18 providing the opening into the interior of the bag.

Figure 4:
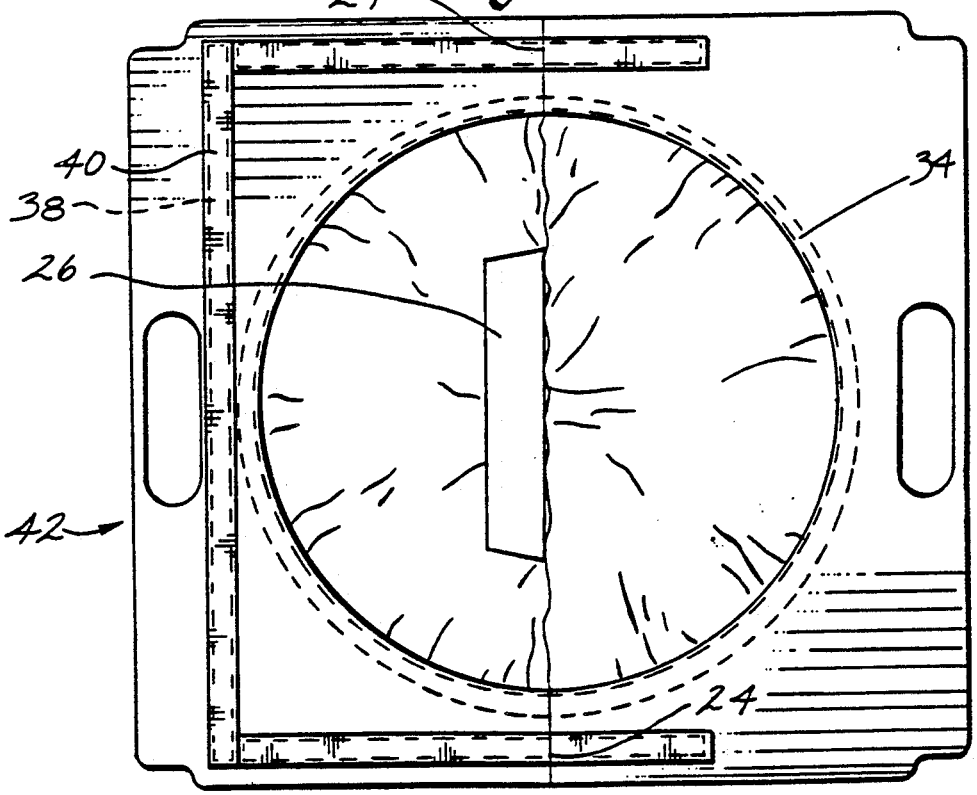
FIG. 4 is a top view of the waste bag according to the present invention.

Further details of the assembly can be seen from FIG. 4 which is a top view of the waste bag in its fully assembled condition. Sheet 24 is divided into a right-hand half 44 and a left-hand half 42 (as viewed in FIG. 4) by means of scored line 24 which acts as an axis to facilitate folding and unfolding the left-hand side 42 of the disposable bag assembly relative to the righthand side 44. Three adhesive strips 38 are located on three sides of the semirigid sheet 16. A removable strip 40 overlies each of the adhesive strips when the bag is first put into use. Subsequent to a person's use of the waste bag, strips 40 are removed and the lefthand half 42 of sheet 16 is folded over into contact with the right-hand half 44 to cause the adhesive strips 38 to engage and adhere to portions of sheet 16 adjacent the edges of right-hand half 44. The packet 26 of gelling compound is also seen in position in the bottom of the waste bag in this view.

After manufacture, the waste bag, according to the present invention, is shipped in a flat condition with halves 42 and 44 overlying each other and the enclosure 30 extending down therefrom in an essentially flat configuration. The user takes a waste bag from a box containing a plurality of such bags and places it on top of a commode, opening the two halves and spreading them so that they overlie the right- and left-hand side of the commode as the user faces it. The enclosure 30 is then pushed into a commode pail, if one is used, to provide a completely sealed enclosure lining the interior of the commode pail. Alternatively the waste bag alone is used without the pail. After waste material has been deposited in the enclosure 30, the user strips off removable strips 40 and moves either the right-hand half of the semirigid sheet 16 over to the left-hand half 42 or vice versa to secure the two halves by means of adhesive strips 38. Any liquid material deposited in the bag causes the packet of gelling compound to release its contents and to gel or solidify the liquid material placed therein and capture any solids. A suitable material for use in this application is a product which identified by the trademark DRI MOP which is manufactured by Multiform Dessicants, Inc., Buffalo, N.Y. Such a material and packet therefor is also described in U.S. Pat. No. 4,748,069.

A disinfectant and deodorant are incorporated into the gelling compound or may also be incorporated into the waste bag as a separate component. A presently preferred material for use as a gelling compound or liquid absorber is a dry absorbent identified as Guardian commode absorbent powder manufactured by Huntington Laboratories, Huntington, In.

When the two halves of the sheet 16 are secured together, the result is a closed assembly ready for disposal. By solidifying the contents with the gelling compound, the risk of spillage is substantially eliminated. By sealing the two halves together, accidental opening is essentially eliminated and hence, possible ejection of the contents in the waste bag is avoided even in the situation where the bag might be dropped after the two halves have been secured together. The waste bag is then lifted from the commode and placed in a container for waste materials.

Although described as usable with a commode such as a portable commode, the waste bag of the present invention is one which is equally as usable without a commode pail. By placing the opened semirigid sheet 16 flat on the frame of most commodes, the disposable waste bag according to the present invention can be used without a rigid pail or any other supports. In some commode frames, it may be desirable to attach or secure sheet 16 or the bag to the frame for additional stability. The waste bag according to the present invention is also suitable for use with portable toilets used while engaging in travel or outdoor activities, for children's training toilets, and with recreational vehicle toilets and the like.

A disposable waste bag according to the present invention eliminates a number of the disadvantages and drawbacks of both the prior art disposable waste bags and reusable commode pails. These include elimination of odors, of the user or a hospital attendant coming in contact with the contents of the waste bag, and essentially complete elimination of the possibility of spillage or leakage from the container. The waste bag according to the present invention is particularly suited for single-handed use with the user being able to open, close and seal it with one hand.

Other configurations of the waste bag according to the present invention are also contemplated. The apertures for defining the handle may be located at the corners rather than along the sides of the semirigid sheet and in this configuration the folding line would lie along the diameter of the bag itself and along the diagonal connecting the opposite corners of the semirigid sheet.

What is claimed is:

1. A disposable waste bag comprising:

a first circularly shaped sheet of a liquid-tight material;

a second circularly shaped sheet of a liquid-tight material, and of approximately the same size as said first sheet, said second sheet being secured to said first sheet along a portion of their respective perimeters to define a waste-containing enclosure having an open end and a closed end;

a third sheet of a semirigid material of a predetermined configuration having an opening in the center thereof, said opening having a perimeter equal to or greater than the portions of said perimeters of the first and second sheets that are not secured together, said portions of said perimeters being secured to said perimeter of said opening;

means for folding the sheet of a semirigid material in half to close the waste-containing enclosure; and handle means incorporated into the semirigid material to permit carrying the waste bag.

2. A waste bag according to claim 1 wherein the opening in the center of the semirigid material is circular.

3. A waste bag according to claim 2 wherein the first sheet of liquid-tight material is heated sealed to the corresponding portion of the second sheet of liquid-tight material.

4. A waste bag according to claim 2 wherein the first sheet of liquid-tight material is adhesively secured to the second sheet of liquid-tight material.

5. A waste bag according to claim 3 wherein the open end of the waste-containing enclosure is heat sealed to the central opening in the semirigid material.

6. A waste bag according to claim 3 wherein the open end of the waste-containing enclosure is adhesively secured to the central opening in the semirigid material.

7. A waste bag according to claim 5 wherein the means for folding the sheet of semirigid material is a preformed crease in the semirigid material, the crease being aligned with a diameter of the central opening.

8. A waste bag according to claim 5 wherein the means for folding the sheet is a scored line in the sheet of semirigid material along a line lying on a diameter of the central opening.

9. A waste bag according to claim 8 wherein the handle means are oval apertures formed in the semirigid material on opposite sides of a scored line therein.

10. A waste bag according to claim 9 including a gelling compound incorporated into the bag prior to the bag being used.

11. A waste bag according to claim 10 including means for securing opposite edges of the semirigid material adjacent the oval apertures together to seal the bag shut.

12. A waste bag according to claim 11 wherein the securing means is at least one adhesive strip on the semirigid material having a removable cover strip overlaid thereon.

* * * * *

UNITED STATES PATENT AND TRADEMARK OFFICE

CERTIFICATE OF CORRECTION

PATENT NO. : 4,996,727

DATED : March 5, 1991

INVENTOR(S) : Cynthia M. Wyatt

It is certified that error appears in the above-identified patent and that said Letters Patent is hereby corrected as shown below:

Title page:

[56] References Cited, U.S. PATENT DOCUMENTS, change "2,537,504 6/1951" to -- 2,537,504 1/1951 --.

Column 2, line 36, change "drawing" to -- drawings --.

Column 3, line 40, change "righthand" to -- right-hand --.
Column 3, line 45, change "lefthand" to -- left-hand --.

Column 4, line 15, change "In" to -- Indiana --.

In the Claims

Column 5, line 17, change "heated" to -- heat --.

Signed and Sealed this

Tenth Day of November, 1992

*Attest:*

DOUGLAS B. COMER

*Attesting Officer*

*Acting Commissioner of Patents and Trademarks*